US011657701B2

(12) United States Patent
Basra et al.

(10) Patent No.: US 11,657,701 B2
(45) Date of Patent: May 23, 2023

(54) SYSTEMS AND METHODS FOR EMERGENCY ALERT AND CALL REGARDING DRIVER CONDITION

(71) Applicant: Toyota Motor North America, Inc., Plano, TX (US)

(72) Inventors: Steven S. Basra, Frisco, TX (US); Senthilkumar Gopal Kalaimani, Chennai (IN); Swathi Manoravi, Anupuram (IN); Suresh Krishnaswami Venkatesan, Chennai (IN); Raja Bose C. Leo Maria Manickam, Chennai (IN)

(73) Assignee: Toyota Motor North America, Inc., Plano, TX (US)

( * ) Notice: Subject to any disclaimer, the term of this patent is extended or adjusted under 35 U.S.C. 154(b) by 0 days.

(21) Appl. No.: 17/392,469

(22) Filed: Aug. 3, 2021

(65) Prior Publication Data

US 2023/0041818 A1 Feb. 9, 2023

(51) Int. Cl.
*G08B 29/18* (2006.01)
*G08B 21/02* (2006.01)

(52) U.S. Cl.
CPC ..... *G08B 29/185* (2013.01); *G08B 21/02* (2013.01)

(58) Field of Classification Search
CPC ..... G08B 21/02; G08B 25/00; G08B 21/182; G08B 29/185; G08B 21/06; G08B 21/18; G08B 23/00; G08B 25/016
See application file for complete search history.

(56) References Cited

U.S. PATENT DOCUMENTS

| | | | | |
|---|---|---|---|---|
| 10,156,848 | B1 * | 12/2018 | Konrardy | B60R 16/0234 |
| 10,343,682 | B2 | 7/2019 | Kolisetty et al. | |
| 2007/0142927 | A1 * | 6/2007 | Nelson | G08B 29/24 700/11 |
| 2014/0294180 | A1 * | 10/2014 | Link, II | G08G 1/205 380/270 |
| 2014/0306814 | A1 | 10/2014 | Ricci | |
| 2015/0042471 | A1 * | 2/2015 | Park | G08B 5/22 340/539.12 |
| 2018/0099678 | A1 | 4/2018 | Absmeier et al. | |
| 2018/0132081 | A1 * | 5/2018 | Ulmansky | H04W 4/42 |
| 2020/0285872 | A1 | 9/2020 | Surendran et al. | |

FOREIGN PATENT DOCUMENTS

| | | | |
|---|---|---|---|
| DE | 10 2017 206 740 | A1 | 10/2018 |
| WO | 2012/093799 | A2 | 7/2012 |
| WO | 2020/200862 | A1 | 10/2020 |
| WO | 2020/205597 | A1 | 10/2020 |

* cited by examiner

*Primary Examiner* — Brian Wilson
(74) *Attorney, Agent, or Firm* — Dinsmore & Shohl LLP

(57) ABSTRACT

A method includes measuring biometric data of a user at a monitoring device. The method further includes outputting, at the monitoring device, an alert to a vehicle computing device within a vehicle based upon detection of a biometric event, such that the party outside of a vehicle is notified. The method also includes analyzing and storing, within an application residing on the monitoring device, the biometric data within the application. The method still further includes outputting, within the application, a predetermined time-frame of the biometric data to the party.

19 Claims, 5 Drawing Sheets

SYSTEMS AND METHODS FOR EMERGENCY ALERT AND CALL REGARDING DRIVER CONDITION

TECHNICAL FIELD

The present application generally relates to driver monitoring and, more particularly, providing an emergency alert for help based upon the monitoring of driver biometric data.

BACKGROUND

When drivers face an emergency, they need assistance immediately. Current vehicle assistance options may trigger an immediate call for assistance in certain events, such as a vehicle crash. Moreover, a vehicle can detect a crash in the form of vehicle damage and automatically initiate a timely call without driver input. However, the driver might not be able to think fast and initiate a timely call for assistance in other types of situations where vehicle damage does not trigger an automatic emergency call, such as if a heart attack is being experienced. Additionally, it is important to prevent automated systems from mistakenly reporting suspected events, which can provide an inconvenience to the driver and distract emergency responder resources from actual emergencies elsewhere.

Accordingly, a need exists to improve the accuracy of detecting emergency events experienced by drivers.

SUMMARY

In one embodiment, a method for measuring biometric data of a user at a monitoring device includes outputting, at the monitoring device, an alert to a vehicle computing device within a vehicle based upon detection of a biometric event, such that a party outside of the vehicle is notified. The method further includes analyzing and storing, within an application residing on the monitoring device, the biometric data within the application and outputting, within the application, a predetermined timeframe of the biometric data to the party.

In another embodiment, a system for a vehicle computing device within a vehicle includes a monitoring device, comprising a processor and memory. The processor and memory are configured to measure biometric data of a user and output an alert to the vehicle computing device based upon detection of a biometric event, such that a party outside of the vehicle is notified. The processor and memory are further configured to analyze and store the biometric data within the application and output a predetermined timeframe of the biometric data to the party.

In yet another embodiment, a vehicle computing device within a vehicle, located within a vehicle, comprises a processor and memory. The vehicle computing device is configured to receive biometric data, corresponding to a predetermined timeframe, from a monitoring device. The vehicle computing device is also configured to receive an alert from an external device pertaining to the biometric data. The vehicle computing device is further configured to output an assistance inquiry to the user. The vehicle computing device is additionally configured to receive assistance confirmation from the user. The vehicle computing device is still further configured to output, to a party outside of the vehicle, an assistance request and the biometric data corresponding to a predetermined timeframe.

These and additional features provided by the embodiments described herein will be more fully understood in view of the following detailed description, in conjunction with the drawings.

BRIEF DESCRIPTION OF THE DRAWINGS

The embodiments set forth in the drawings are illustrative and exemplary in nature and not intended to limit the subject matter defined by the claims. The following detailed description of the illustrative embodiments can be understood when read in conjunction with the following drawings, where like structure is indicated with like reference numerals and in which:

DETAILED DESCRIPTION

Embodiments of the present disclosure are directed to measuring driver biometric data. More specifically, coordinating the on-going monitoring of biometric data of a driver via a monitoring and/or wearable device with the vehicle's computing device can provide a crucial, real-world benefit to the driver in instances where their biometric data indicates that they may need assistance. This may be particularly important when symptoms of a serious health event, such as a heart attack, may not be noticed or understood by the driver, but are detected by their smartwatch. An application, which may reside on another device such as the driver's smartphone, can coordinate an alert strategy by sending an alert notice to a provider in the cloud, while protecting the driver's medical privacy by withholding the biometric data from the provider and only providing the driver's biometric data to the vehicle computing device. In this way, the provider in the cloud can forward on the alert to the vehicle computing device, which can then prompt the driver for permission to call a responder for help. If the driver agrees, the vehicle computing device can then contact a responder and provide them at least a portion of the biometric data, which may be helpful to the responder before and at the response scene. Various embodiments of driver biometric data alerts are described in detail below.

Figure 1:
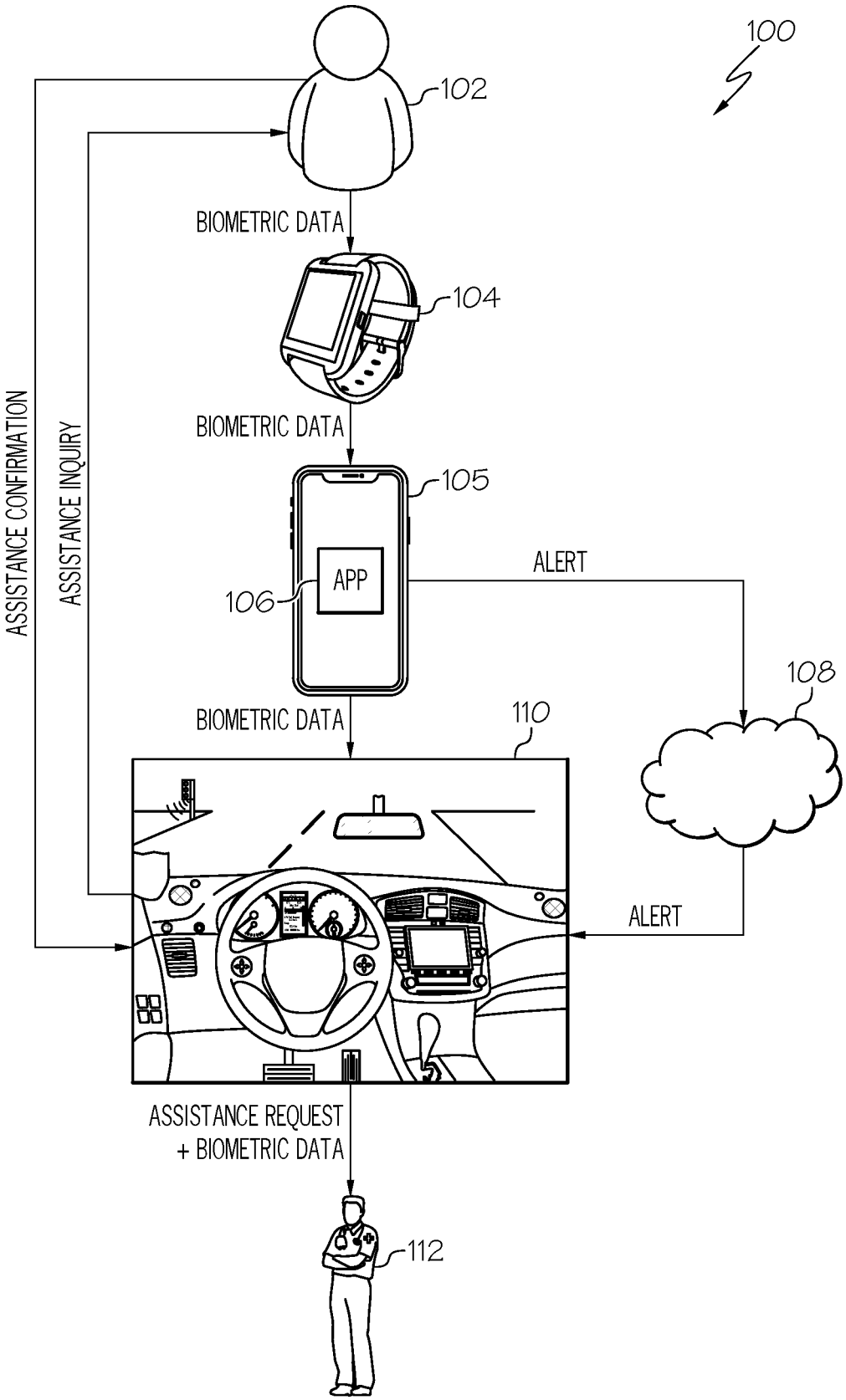
FIG. 1 schematically illustrates a computing environment having a vehicle computing device alert a responder based upon biometric data and alert communications received in combination from the cloud, a smartphone app, and a smartwatch worn by the user, according to one or more embodiments described and illustrated herein.

Referring now to FIG. 1, example components of one embodiment of an environment 100 are schematically depicted. The environment 100 includes a user 102 (e.g., a vehicle driver, an operator, an occupant, or any other person) having a wearable or non-wearable monitoring device capable of measuring or otherwise capturing biometric data of the user 102. In this embodiment, the monitoring device is a smartwatch 104. However, in other examples, the monitoring device may comprise any suitable type of device including wearable devices, such as an arm band, headband, hat, footwear, glasses, contact lens, clothing, implantable devices, or non-wearable devices capable of measuring or otherwise capturing the biometric data of the user 102. Biometric data may be any type of data collectible by a smartwatch 104 or other device, such as, by way of non-limiting example, vital signs data (e.g., heart rate, resting heart rate, walking heart rate average, heart rate variability, oxygen saturation, body temperature, diastolic blood pressure, respiratory rate, systolic blood pressure, sleeping pattern, stress level, electrocardiogram (ECG), core temperature, or eating habits), activity data (e.g., step count, distance walking/running, distance cycling, push count, distance wheelchair, swimming distance, swimming stroke count, downhill snow sports distance, basal energy burned, active energy burned, flights of stairs climbed, stand time, or exercise time), and the like.

In this embodiment, the smartwatch 104 may provide the biometric data to an application 106 residing on another device, such as a smartphone 105, although any device capable of receiving data from the smartwatch 104 and/or hosting the application 106 may be utilized. In other embodiments, the application 106 may reside within the smartwatch 104 and directly receive the biometric data of the user 102 from within the smartwatch 104. Any suitable type of application 106, software, program, and the like may be utilized.

Figure 4:
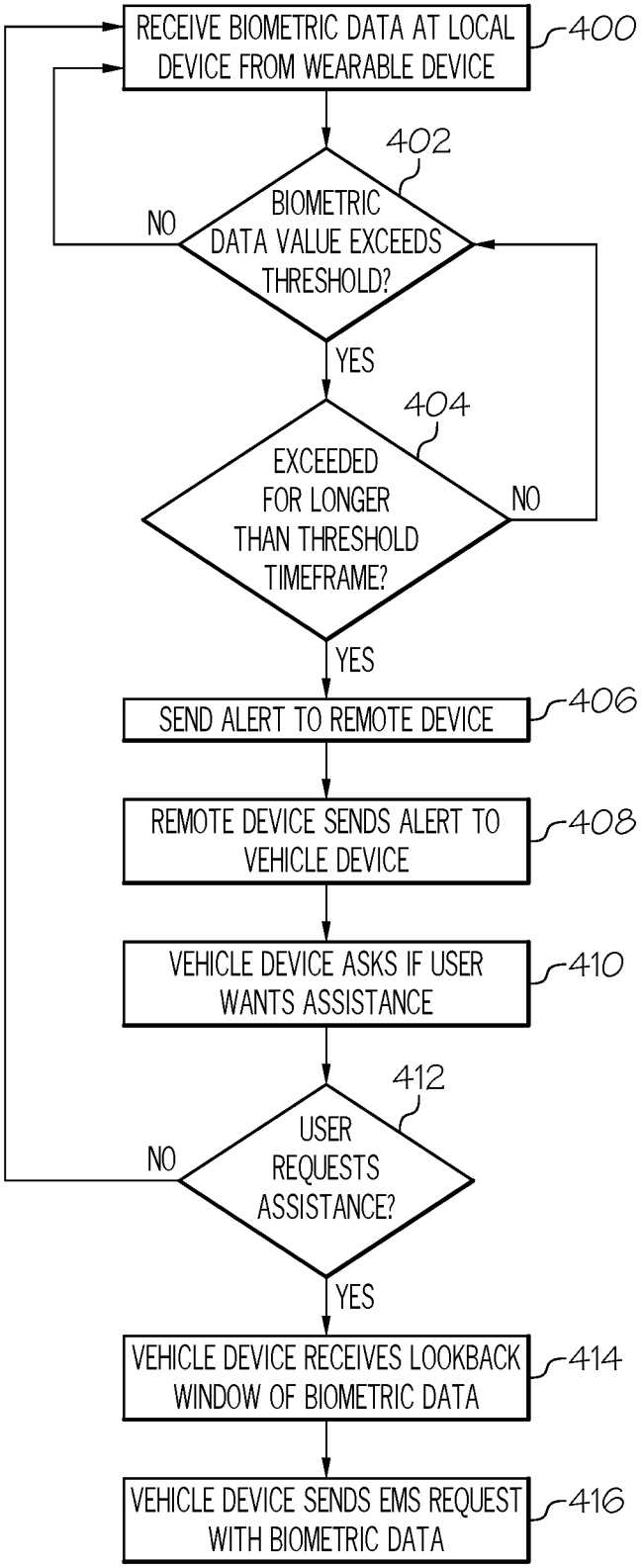
FIG. 4 illustrates a flowchart for a vehicle computing system notifying a responder of an emergency based upon user confirmation, an alert, and biometric data received from the user, according to one or more embodiments described and illustrated herein.

As described in more detail with respect to FIG. 4, the application 106 may assess the biometric data to determine whether to proceed with sending an alert to a provider 108 and/or sending at least some of the biometric data to a vehicle computing device 110. The provider 108 may be any device, service, company, or other type of entity capable of remotely receiving an alert from the application 106, such as via the cloud, a server, or any other suitable remote communication protocol. The vehicle computing device 110 may be any type of device/system capable of communicating with a person in a vehicle, such as an entertainment console or other in-vehicle audio/visual system that may employ one or more displays, touchscreens, speakers, buttons, media players, and the like.

In this embodiment, a single application 106 may collect and assess the biometric data, and send the alert to the provider 108. In another embodiment, a plurality of applications 106 may each separately collect the biometric data, assess the biometric data, send the alert to the provider 108, and/or provide the biometric data to the vehicle computing device 110. Some/all of the multiple applications 106 may reside on one or more different devices, such as multiple smartphones 105 and/or other suitable devices.

In this embodiment, the application 106 may provide the biometric data to the vehicle computing device 110 but not the provider 108 in order to, for example, protect the data/medical privacy of the user 102. In some embodiments, the provider 108 may receive general information, such as an indication that the user 102 is having a heart attack or other general description of the issue without being provided the specifics from the biometric data. In other embodiments, some (but not all) biometric data may be sent to the provider 108. Therefore, an alert without the biometric data may be sent to the provider 108, which may identify the user 102 or keep the identity anonymous or pseudo-anonymous (such as creating a temporary ID based upon the vehicle). In this embodiment, after the application 106 provides an alert to the provider 108, the provider 108 may directly send the alert to the vehicle computing device 110, or first assess the alert for criteria such as severity or urgency of the alert. The alert that the provider 108 sends to the vehicle computing device 110 may be the same as the alert received from the application 106, or the provider 108 may add and/or remove information with respect to the alert that it sends to the vehicle computing device 110.

Once it receives the alert, the vehicle computing device 110 may perform an assistance inquiry with the user 102. For example, the vehicle computing device 110 may provide audio and/or visual cues, or any other suitable way to get the attention of the user 102, to explain the nature of the alert. In another embodiment, the assistance inquiry may be sent to the user 102 without regard to whether the biometric data has yet been received at the vehicle computing device 110.

In this embodiment, the user 102 may provide confirmation that assistance is desired, or decline the assistance. The biometric data may be provided to the user 102, such as having the vehicle computing device 110 visually display the user's live or recorded heart rate, or verbally explaining their heart rate and/or the reason for concern to the user, by way of non-limiting example. In another embodiment, confirmation from the user 102 may not be needed, such that the assistance request and biometric data may be directly sent to a responder 112.

The responder 112 may be any person, service, agency, company, robot, or anything capable of rendering or summoning aid for a user 102. For example, the responder 112 may be emergency medical services (EMS), a call center representative, an emergency medical technician (EMT) or other medical personnel, law enforcement, fire department, and the like. In another embodiment, the responder 112 may be an employee of or affiliated with the provider 108.

In this embodiment, the vehicle computing device 110 may await user permission or confirmation before taking further action. In another embodiment, the vehicle computing device 110 may wait for a period of time for a response from the user 102, after which time the vehicle computing device 110 may automatically take further action to notify a responder 112, which could presume that the user 102 may have become unconscious or otherwise unable to respond. In this embodiment, if the user 102 indicates that they desire assistance, then the vehicle computing device 110 may contact the responder 112. The vehicle computing device 110 may put the user 102 in video and/or audio communication with the responder 112 (such as a video or phone call) and/or may provide the relevant information (e.g., assistance request confirmed by the user 102 and/or at least some of the biometric data) to the responder 112.

Figure 2A:
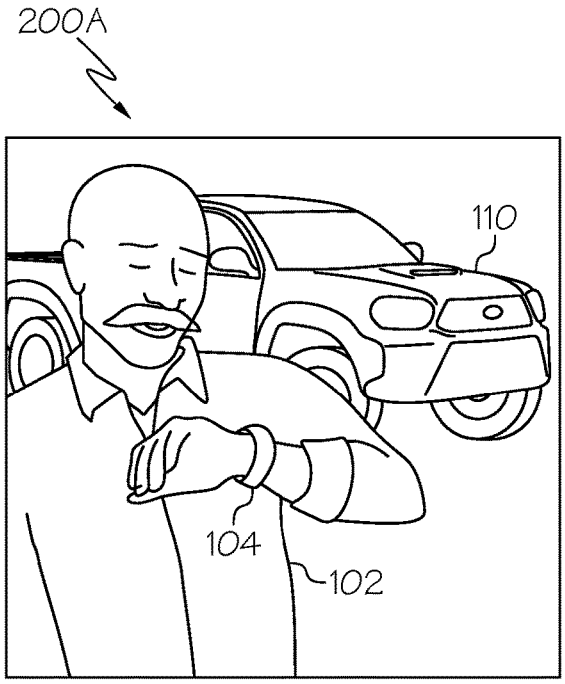
FIG. 2A illustrates a user having their biometric data measured by their smartwatch, according to one or more embodiments described and illustrated herein.

Turning to FIG. 2A, an illustration 200A depicts the user 102 having their biometric data measured by their smartwatch 104, which detects a cardiac issue that the user 102 does not know is occurring. The smartwatch 104 has sent the biometric data to the application 106 on the user's smartphone 105, such that application 106 has in turn sent an alert to the provider 108, and has also sent the biometric data to the vehicle computing device 110.

Figure 2B:
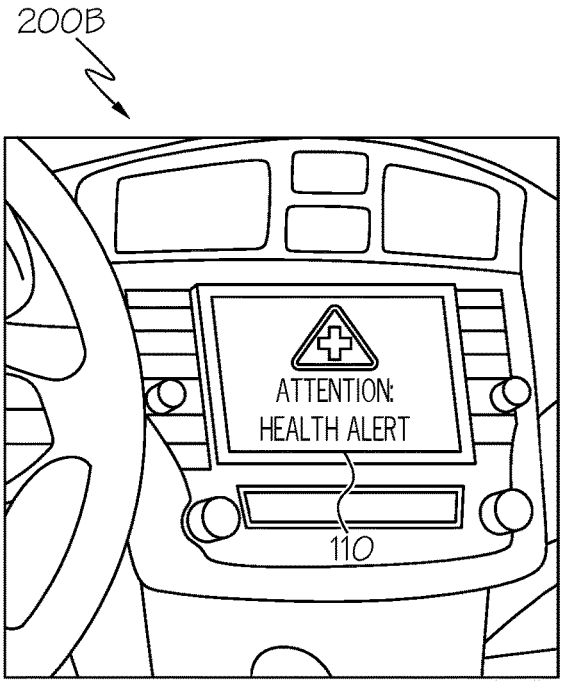
FIG. 2B continues with the scenario of FIG. 2A by illustrating a vehicle computing device displaying a warning based upon the biometric data, according to one or more embodiments described and illustrated herein.

Turning to FIG. 2B, an illustration 200B continuing from FIG. 2A depicts the vehicle computing device 110 displaying a visual warning to the user 102 based upon the biometric data.

Figure 2C:
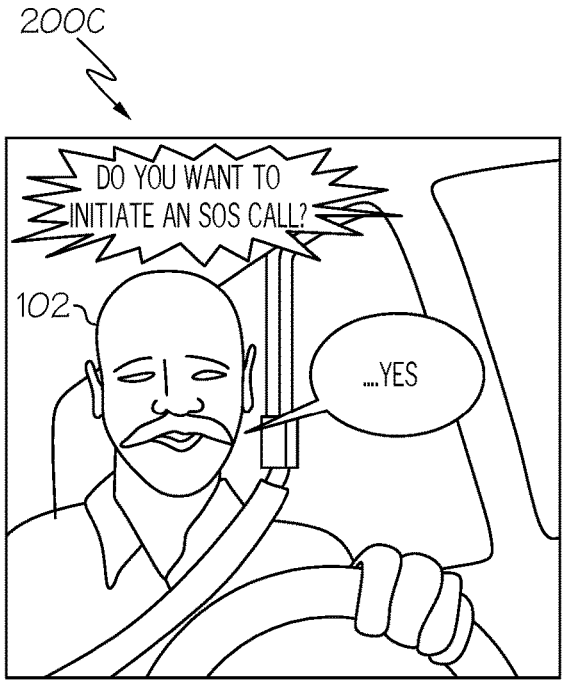
FIG. 2C continues with the scenario of FIG. 2B by illustrating the vehicle computing device requesting permission to notify a responder, according to one or more embodiments described and illustrated herein.

Turning to FIG. 2C, an illustration 200C continuing from FIG. 2B depicts the vehicle computing device 110 requesting permission from the user 102 to notify the responder 112. The user 102 provides verbal approval to notify a responder 112.

Figure 2D:
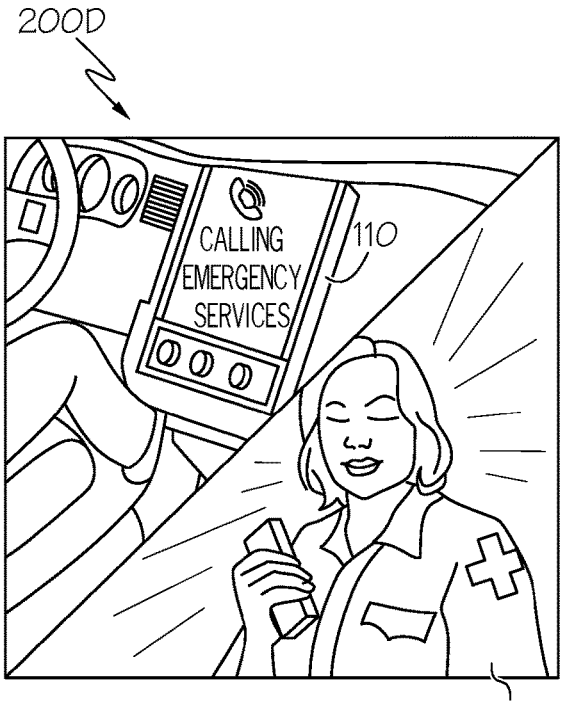
FIG. 2D continues with the scenario of FIG. 2C by illustrating the user's vehicle computing device contacting a responder, according to one or more embodiments described and illustrated herein.

Turning to FIG. 2D, an illustration 200D continuing from FIG. 2C depicts the user's vehicle computing device 110 contacting the responder 112 who is now in contact with the user 102.

Figure 3A:
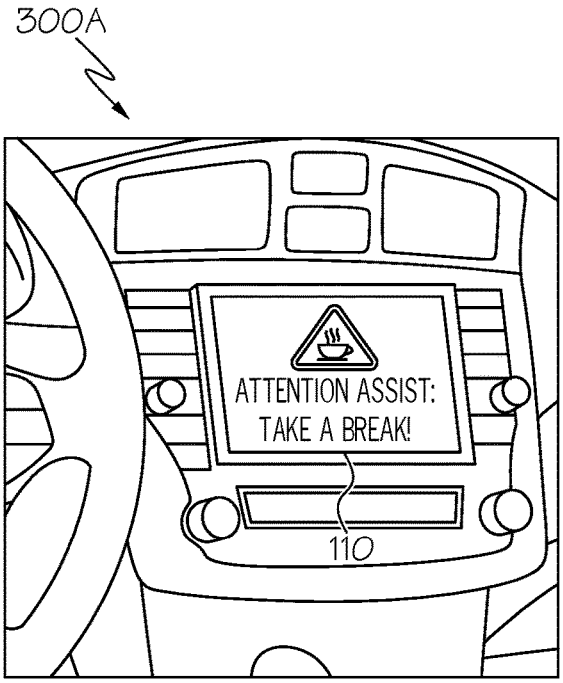
FIG. 3A illustrates a vehicle computing device prompting a user to take a break based upon biometric data received from the user, according to one or more embodiments described and illustrated herein.

Turning to FIG. 3A, an illustration 300A depicts another embodiment in which the vehicle computing device 110 prompts the user 102 to take a break based upon biometric data received from the user 102. In this example, the smartwatch 104 detects user fatigue based upon the biometric data. The smartwatch 104 has sent the biometric data to the application 106 on the user's smartphone 105, such that application 106 has sent an alert to the provider 108, and has similarly sent a corresponding alert to the vehicle computing device 110. In another embodiment, the alert may be directly sent from the smartphone 105 to the vehicle computing device 110.

Figure 3B:
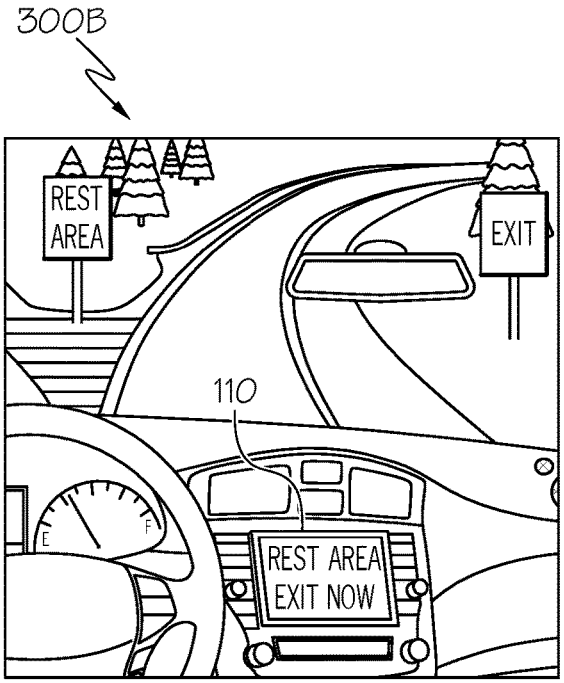
FIG. 3B continues with the scenario of FIG. 3A by illustrating the user's vehicle computing device displaying a rest area notification, according to one or more embodiments described and illustrated herein.

Turning to FIG. 3B, an illustration 300B continuing from FIG. 3A depicts the user's vehicle computing device 110 displaying a rest area notification, based upon the vehicle computing device 110 utilizing mapping software to find a suitable rest area ahead. Any suitable mapping/navigation software may be utilized.

Figure 3C:
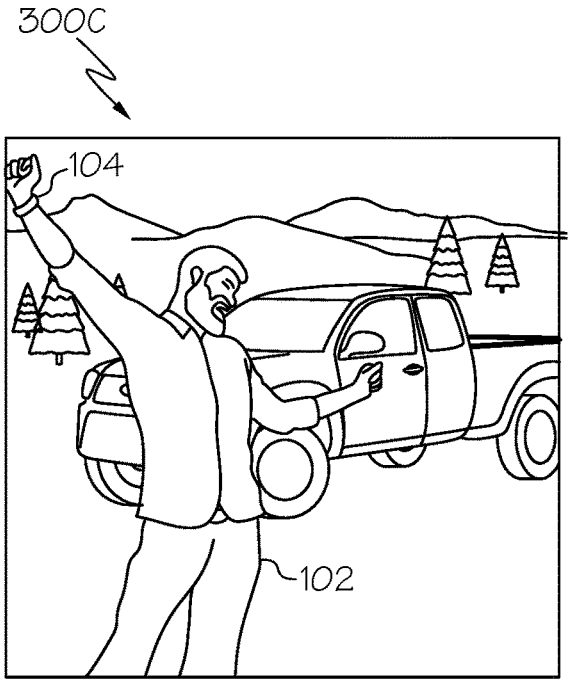
FIG. 3C continues with the scenario of FIG. 3B by illustrating the user at the rest area wearing his smartwatch and stretching, according to one or more embodiments described and illustrated herein.

Turning to FIG. 3C, an illustration 300C continuing from FIG. 3B depicts the user 102 at the rest area wearing his smartwatch 104 and stretching to get refreshed from his tiredness.

Figure 3D:
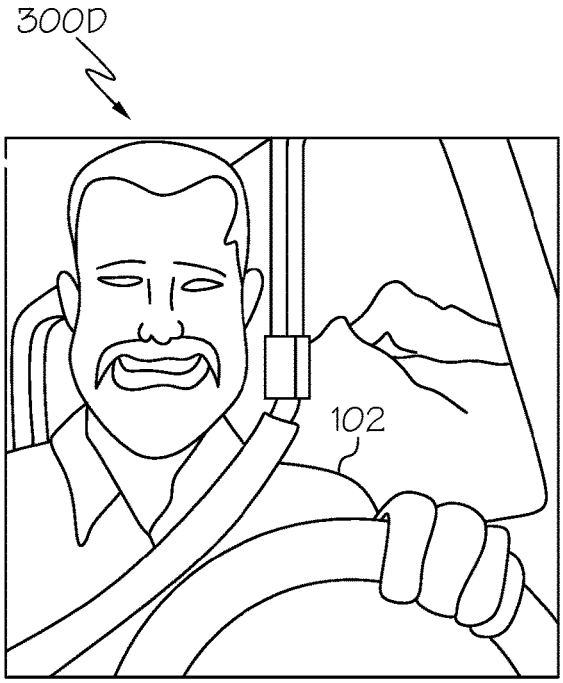
FIG. 3D continues with the scenario of FIG. 3C by illustrating the user back in his vehicle refreshed from the rest area, according to one or more embodiments described and illustrated herein.

Turning to FIG. 3D, an illustration 300D continuing from FIG. 3C depicts the user 102 back in his vehicle, now refreshed from stretching at the rest area. In some embodiments, the user's smartwatch 104 may continue monitoring the user 102 and provide the biometric data to the user's smartphone 105 to verify that the user 102 is no longer fatigued before they drive again.

In other embodiments, feedback may be provided to the user 102 with regard to their step count (i.e., suggestion to walk more) or to take a break, which may be determined based on the amount of time the user 102 has been driving. Other data that may be collected and utilized in embodiments includes user sleep data, user seat belt data (i.e., whether the user 102 is wearing their seatbelt), key-on data with regards to when the vehicle has started and stopped, and user sleep data, any of which may be utilized to prompt the user 102. In another embodiment, the user's workout data may be collected by the smartwatch 104 in order to allow the vehicle computing device 110 to create/suggest/modify the user's workout scheduling, such as based upon established patterns.

Turning to FIG. 4, a flowchart is shown illustrating a method that may be performed by a vehicle computing system to notify a responder of an emergency based upon user confirmation, an alert, and biometric data received from the user, according to one embodiment. At block 400, a local device (e.g., the smartphone 105) receives a user's biometric data (e.g., heartrate) from a wearable and/or monitoring device (e.g., the smartwatch 104).

At block 402, a determination is made (e.g., by the smartphone 105 and/or the application 106) as to whether the biometric data value exceeds a predetermined threshold, such as whether a user's heart rate is higher than a threshold level. If not ("NO" at block 402), then the method returns to block 400. If, however, the biometric data (e.g., the user's heart rate) exceeds the threshold ("YES" at block 402), then the method proceeds to block 404, where a determination is made as to whether the biometric data has been exceeding the threshold at block 402 for longer than a predetermined threshold timeframe.

If not ("NO" at block 404), for example the rapid heart rate has not been occurring for longer than a threshold period of time, then the flowchart returns to block 402 to continue monitoring the biometric data (e.g., the user's heart rate). If, however, the heartrate has been occurring above the threshold value for longer than the threshold period of time ("YES" at block 404), then at block 406, the application 106 on the smartphone 105 may send an alert to a remote device, such as one utilized by the provider 108. At block 408, the remote device may then send a corresponding alert to the vehicle computing device 110 (or vehicle device).

At block 410, the vehicle computing device 110 outputs a cue to the user 102 asking whether the user 102 wants assistance. At block 412, the vehicle computing device 110 determines whether the user 102 requests or otherwise wants assistance. If not ("NO" at block 412), then the flowchart returns to block 400 to continue monitoring the user's biometric data. If, however, the user does request assistance ("YES" at block 412), then at block 414, the vehicle computing device 110 receives a lookback window (e.g., a predetermined timeframe) of the biometric data, which may be of a customizable duration in some embodiments.

Continuing with this example, the application 106 may provide to the vehicle computing device 110 the last 5 minutes of biometric data, such as cardiac activity, that operates as a rolling window of the most recent 5 minutes. At block 416, the vehicle computing device 110 may send a request for assistance to the responder 112 (such as EMS) with the user's biometric data according to the predetermined timeframe. The predetermined timeframe may be used to keep track of various types of data within the predetermined timeframe, such as a continuously-updated 5 minute heart rate average that can be provided to the responder 112 while they are en route. While the above described example uses 5 minutes as the duration of the lookback window, it should be understood that in other examples, the lookback window may be longer or shorter than 5 minutes.

Figure 5:
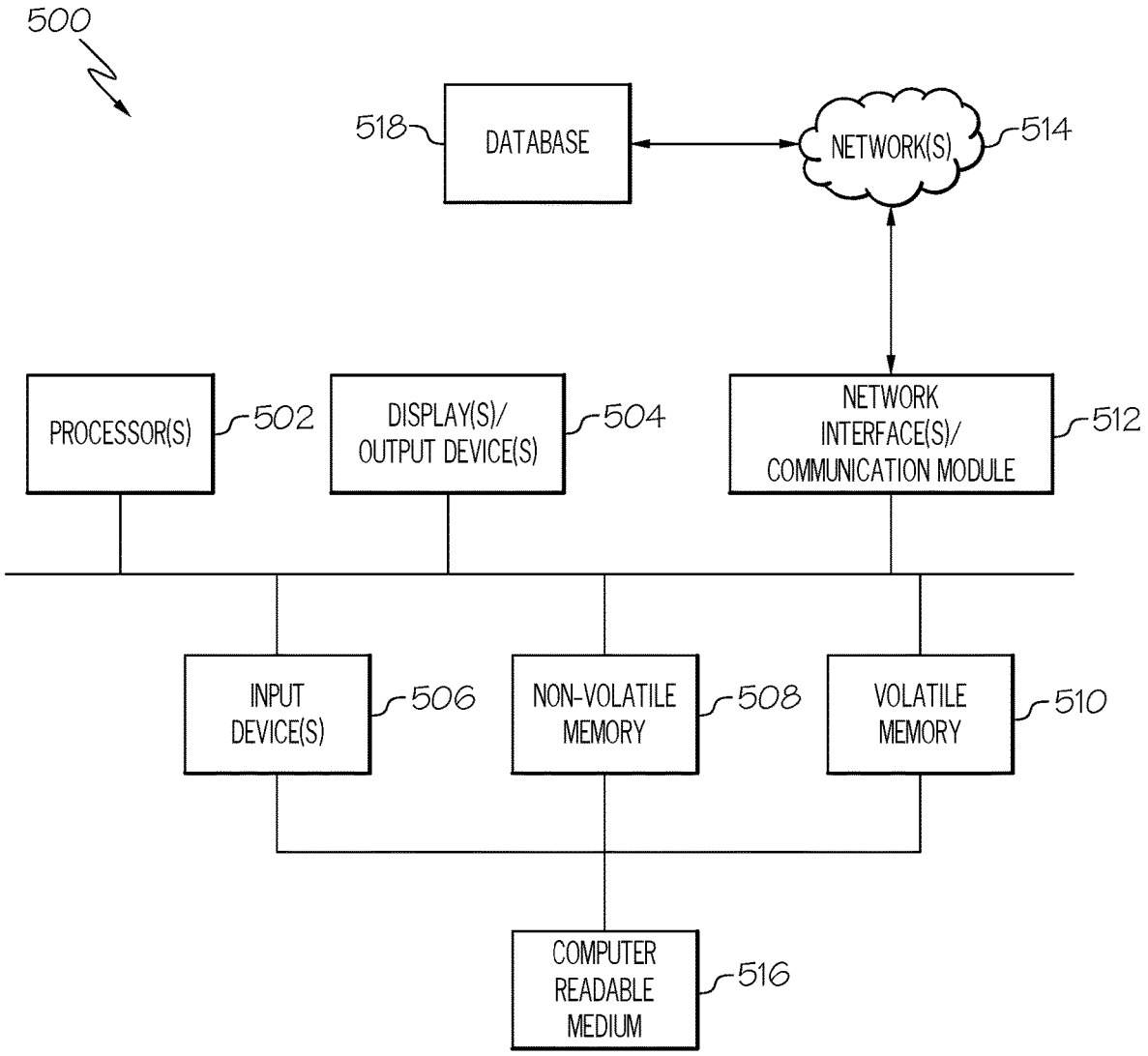
FIG. 5 is a block diagram illustrating computing hardware utilized in one or more devices for implementing various processes and systems, according to one or more embodiments shown and described herein.

Turning now to FIG. 5, a block diagram illustrates an exemplary computing device 500, through which embodiments of the disclosure can be implemented. The computing device 500 described herein is but one example of a suitable computing device and does not suggest any limitation on the scope of any embodiments presented. The computing device 500 in some embodiments may also be utilized to implement the smartwatch 104, the smartphone 105, the provider 108 that may be cloud-based or otherwise remote, the vehicle computing device 110, and/or any combination thereof. Nothing illustrated or described with respect to the computing device 500 should be interpreted as being required or as creating any type of dependency with respect to any element or plurality of elements. In various embodiments, the computing device 500 may include, but need not be limited to, a desktop, laptop, server, client, tablet, smartphone, or any other type of device that can utilize data. In an embodiment, the computing device 500 includes at least one processor 502 and memory comprising non-volatile memory 508 and/or volatile memory 510. The computing device 500 can include one or more displays and/or output devices 504 such as, for example, monitors, speakers, headphones, projectors, wearable-displays, holographic displays, and/or printers. Output devices 504 may further include, for example, a display and/or speakers of the smartwatch 104, the smartphone 105, a remote/cloud device of the provider 108, the vehicle computing device 110, devices that emit energy (radio, microwave, infrared, visible light, ultraviolet, x-ray and gamma ray), electronic output devices (Wi-Fi, radar, laser, etc.), audio (of any frequency), and the like.

The computing device 500 may further include one or more input devices 506 which can include, by way of example, any type of mouse, keyboard, disk/media drive, memory stick/thumb-drive, memory card, pen, touch-input device, biometric scanner, voice/auditory input device, motion-detector, camera, scale, and the like. Input devices 506 may further include sensors, cameras, sensing components of the smartwatch 104, the smartphone 105, a remote device within the cloud utilized by the provider 108, the vehicle computing device 110, (e.g., a touch screen, buttons, an accelerometer, a light sensor, etc.), and any device capable of measuring data such as motion data (e.g., an accelerometer, GPS, a magnetometer, a gyroscope, etc.), biometric data (e.g., blood pressure, pulse, heart rate, perspiration, temperature, voice, facial-recognition, motion/gesture tracking, gaze tracking, iris or other types of eye recognition, hand geometry, oxygen saturation, glucose level, fingerprint, DNA, dental records, weight, or any other suitable type of biometric data, etc.), video/still images, and audio (including human-audible and human-inaudible ultrasonic sound waves). Input devices 506 may include cameras (with or without audio recording), such as digital and/or analog cameras, still cameras, video cameras, thermal imaging cameras, infrared cameras, cameras with a charge-couple display, night-vision cameras, three-dimensional cameras, webcams, audio recorders, and the like.

The computing device 500 typically includes non-volatile memory 508 (e.g., ROM, flash memory, etc.), volatile memory 510 (e.g., RAM, etc.), or a combination thereof. A network interface 512 can facilitate communications over a network 514 with other data source such as a database 518 via wires, a wide area network, a local area network, a personal area network, a cellular network, a satellite network, and the like. Suitable local area networks may include wired Ethernet and/or wireless technologies such as, for example, wireless fidelity (Wi-Fi). Suitable personal area networks may include wireless technologies such as, for example, IrDA, Bluetooth, Wireless USB, Z-Wave, ZigBee, and/or other near field communication protocols. Suitable personal area networks may similarly include wired computer buses such as, for example, USB and FireWire. Suitable cellular networks may include, but are not limited to, technologies such as LTE, WiMAX, UMTS, CDMA, and GSM. Network interface 512 can be communicatively coupled to any device capable of transmitting and/or receiving data via one or more network(s) 514. Accordingly, the network interface 512 can include a communication transceiver for sending and/or receiving any wired or wireless communication. For example, the network interface 512 may include an antenna, a modem, LAN port, Wi-Fi card, WiMax card, mobile communications hardware, near-field communication hardware, satellite communication hardware and/or any wired or wireless hardware for communicating with other networks and/or devices.

A computer-readable medium 516 may comprise a plurality of computer readable mediums, each of which may be either a computer readable storage medium or a computer readable signal medium. A computer readable storage medium may reside, for example, within an input device 506, non-volatile memory 508, volatile memory 510, or any combination thereof. A computer readable storage medium can include tangible media that is able to store instructions associated with, or used by, a device or system. A computer readable storage medium includes, by way of example: RAM, ROM, cache, fiber optics, EPROM/Flash memory, CD/DVD/BD-ROM, hard disk drives, solid-state storage, optical or magnetic storage devices, diskettes, electrical connections having a wire, or any combination thereof. A computer readable storage medium may also include, for example, a system or device that is of a magnetic, optical, semiconductor, or electronic type. Computer readable storage media and computer readable signal media are mutually exclusive.

A computer readable signal medium can include any type of computer readable medium that is not a computer readable storage medium and may include, for example, propagated signals taking any number of forms such as optical, electromagnetic, or a combination thereof. A computer readable signal medium may include propagated data signals containing computer readable code, for example, within a carrier wave. Computer readable storage media and computer readable signal media are mutually exclusive.

The computing device 500 may include one or more network interfaces 512 to facilitate communication with one or more remote devices, which may include, for example, client and/or server devices. This is depicted, for example, as the cloud implementation for the provider 108 in FIG. 1, although any suitable network configuration may be utilized. The network interface 512 may also be described as a communications module, as these terms may be used interchangeably. The database 518 is depicted as being accessible over the network 514 and may reside within a server, the cloud, or any other configuration to support being able to remotely access data and store data in the database 518.

Accordingly, embodiments of the present disclosure are directed to methods and systems that facilitate biometrically-based alerts to remote providers while keeping a user's biometric data local with respect to the vehicle computing device.

It is noted that recitations herein of a component of the present disclosure being "configured" or "programmed" in a particular way, to embody a particular property, or to function in a particular manner, are structural recitations, as opposed to recitations of intended use. More specifically, the references herein to the manner in which a component is "configured" or "programmed" denotes an existing physical condition of the component and, as such, is to be taken as a definite recitation of the structural characteristics of the component.

The order of execution or performance of the operations in examples of the disclosure illustrated and described herein is not essential, unless otherwise specified. That is, the operations may be performed in any order, unless otherwise specified, and examples of the disclosure may include additional or fewer operations than those disclosed herein. For example, it is contemplated that executing or performing a particular operation before, contemporaneously with, or after another operation is within the scope of aspects of the disclosure.

It is noted that the terms "substantially" and "about" and "approximately" may be utilized herein to represent the inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

While particular embodiments have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A method comprising:

receiving an alert from an external device indicating existence of a biometric event of a user based on biometric data of the user captured by a monitoring device, the alert corresponding to a predetermined timeframe and not including any of the biometric data captured by the monitoring device;

outputting, via a vehicle computing device within a vehicle of the user, an assistance inquiry as to whether to notify a party outside the vehicle, wherein the assistance inquiry does not include the biometric data;

receiving assistance confirmation from the user; and upon receipt of the assistance confirmation, receiving the biometric data corresponding to the predetermined timeframe from the monitoring device and outputting, to the party outside of the vehicle, an assistance request and the biometric data corresponding to the predetermined timeframe.

2. The method of claim 1, further comprising receiving the biometric data from the monitoring device at a client device in which the application also resides.

3. The method of claim 2, further comprising outputting the biometric data from the monitoring device to the client device.

4. The method of claim 1, further comprising outputting, at the monitoring device, the alert based upon the biometric data having a value that exceeds a predetermined threshold value for longer than a predetermined threshold duration.

5. The method of claim 1, wherein the predetermined timeframe has a customizable duration.

6. The method of claim 1, further comprising outputting the alert from the vehicle computing device to the user based upon the biometric data having a value that exceeds a predetermined threshold value for longer than a predetermined threshold duration.

7. The method of claim 1, wherein the alert identifies the user to the external device as a temporary identification to maintain anonymity of the user.

8. The method of claim 7, wherein the temporary identification is based on the vehicle.

9. The method of claim 1, wherein the vehicle computing device automatically sends the assistance request to the party outside of the vehicle if no assistance confirmation is received within a period of time.

10. The method of claim 1, further comprising:

measuring the biometric data of the user at the monitoring device;

analyzing and storing, within an application residing on the monitoring device, the biometric data within the application; and determining, by the application, occurrence of the biometric event based on the predetermined timeframe of the biometric data.

11. The method of claim 10, further comprising:

in response to the determining the biometric event, sending the alert indicative of the biometric event to the external device from the application, wherein the alert does not include the biometric data; and receiving, at the vehicle computing device within the vehicle, the alert from the external device, wherein the outputting the assistance inquiry at the vehicle computing device occurs in response to the receiving the alert at the vehicle computing device.

12. A vehicle computing device, located within a vehicle, comprising memory and a processor, configured to receive an alert from an external device indicating existence of a biometric event based on biometric data captured by a monitoring device, the alert corresponding to a predetermined timeframe and not including any of the biometric data captured by the monitoring device;

output an assistance inquiry to a user;

receive assistance confirmation from the user; and upon receipt of the assistance confirmation, receive the biometric data corresponding to the predetermined timeframe from the monitoring device and output, to a party outside of the vehicle, an assistance request and the biometric data corresponding to the predetermined timeframe.

13. The vehicle computing device of claim 12, wherein:

the monitoring device comprises a processor and memory, and is configured to:

measure the biometric data of the user;

the external device is in communication with the vehicle computing device and the monitoring device; and the monitoring device includes an application residing on the monitoring device, the monitoring device being configured to:

analyze and store the biometric data within the application; and determine occurrence of the biometric event based on the predetermined timeframe of the biometric data; and wherein:

the monitoring device sends the alert indicative of the biometric event to the external device from the application, wherein the alert does not include the biometric data;

the external device sends the alert, but not the biometric data, to the vehicle computing device; and upon receiving the alert from the external device, the vehicle computing device outputs the assistance inquiry to the user asking the user whether to notify the party outside the vehicle.

14. The vehicle computing device of claim 13, wherein the application also resides in a client device.

15. The vehicle computing device of claim 14, wherein the monitoring device is configured to output the biometric data to the client device.

16. The vehicle computing device of claim 13, wherein the monitoring device is further configured to output the alert based upon the biometric data having a value that exceeds a predetermined threshold value for longer than a predetermined threshold duration.

17. The vehicle computing device of claim 13, wherein the predetermined timeframe has a customizable duration.

18. The vehicle computing device of claim 13, wherein the vehicle computing device automatically sends the assistance request to the party outside of the vehicle if no assistance confirmation is received within a period of time.

19. The vehicle computing device of claim 12, wherein the vehicle computing device automatically outputs the assistance request to the party outside of the vehicle if no assistance confirmation is received within a period of time.

* * * * *